US009162507B2

(12) United States Patent
Tanaka et al.

(10) Patent No.: US 9,162,507 B2
(45) Date of Patent: Oct. 20, 2015

(54) PRINTING APPARATUS

(75) Inventors: Hiroyuki Tanaka, Kawasaki (JP); Shunya Sunouchi, Kawasaki (JP); Seiji Suzuki, Ebina (JP); Takaya Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 473 days.

(21) Appl. No.: 12/965,506

(22) Filed: Dec. 10, 2010

(65) Prior Publication Data

US 2011/0285767 A1 Nov. 24, 2011

(30) Foreign Application Priority Data

May 19, 2010 (JP) ..... 2010-115494

(51) Int. Cl.
*B41J 29/393* (2006.01)
*B41J 2/175* (2006.01)

(52) U.S. Cl.
CPC ..... *B41J 29/393* (2013.01); *B41J 2/175* (2013.01); *B41J 2/17566* (2013.01)

(58) Field of Classification Search
None
See application file for complete search history.

(56) References Cited

U.S. PATENT DOCUMENTS

| | | | | |
|---|---|---|---|---|
| 7,090,147 | B2 * | 8/2006 | Lovett | 239/332 |
| 8,360,566 | B2 * | 1/2013 | Uptergrove | 347/89 |
| 2009/0040250 | A1 * | 2/2009 | Suzuki | 347/7 |
| 2009/0213163 | A1 | 8/2009 | Bansyo | |

FOREIGN PATENT DOCUMENTS

| | | | |
|---|---|---|---|
| JP | 2000-280493 | A | 10/2000 |
| JP | 2003-019816 | A | 1/2003 |
| JP | 2004-130701 | A | 4/2004 |
| JP | 2006-021383 | A | 1/2006 |
| JP | 2009-196208 | A | 9/2009 |

* cited by examiner

*Primary Examiner* — Uyen Chau N Le
*Assistant Examiner* — Chad Smith
(74) *Attorney, Agent, or Firm* — Canon U.S.A. Inc., IP Division

(57) ABSTRACT

A printing apparatus includes a first circulation pump which is provided in a channel between a print head and a first storage tank and which supplies ink from a second storage tank to the print head. The printing apparatus further includes a second circulation pump which is provided in a channel between the first storage tank and the second storage tank which supplies ink from the first storage tank to the second storage tank. The printing apparatus further includes a control unit which controls the driving of the first circulation pump and second circulation pump, and a detecting unit which detects the amount of ink stored in the second storage tank. The control unit controls the driving of the second circulation pump on the basis of a detection result by the detecting unit.

7 Claims, 14 Drawing Sheets

PRINTING APPARATUS

BACKGROUND OF THE INVENTION

1. Field of the Invention

The present invention relates to a printing apparatus which prints an image on a sheet by ejecting ink.

2. Description of the Related Art

Japanese Patent Laid-Open No. 2009-196208 discloses an ink-jet printer in which ink is first supplied from an ink cartridge to a downstream tank and which has an ink circulation path for circulating ink between an ink head, an upstream tank, and a downstream tank.

However, according to Japanese Patent Laid-Open No. 2009-196208, one pump is used to circulate ink. Thus, under some conditions for ejecting ink from the ink head, the amounts of ink reserved in the upstream tank and downstream tank are not stable. This causes a problem that simultaneous implementation of a continuous printing operation and ink circulation is difficult.

SUMMARY OF THE INVENTION

The present invention provides a printing apparatus which allows simultaneous implementation of continuous printing operation and ink circulation and thus implements high quality printing operations.

The present invention further provides a printing apparatus having a print head which ejects ink, a first storage tank which stores ink, and a second storage tank which stores ink supplied from the first storage tank and supplies ink to the print head, in which ink not ejected from the print head is collected to the first storage tank, the printing apparatus including a first pump which is provided in a channel between the print head and the first storage tank and which supplies ink from the second storage tank to the print head, a second pump which is provided in a channel between the first storage tank and the second storage tank and which supplies ink from the first storage tank to the second storage tank, a control unit which controls driving of the first pump and the second pump; and a detecting unit which detects the amount of ink stored in the second storage tank, wherein the control unit controls the driving of the second pump on the basis of detection result by the detecting unit.

Further features of the present invention will become apparent from the following description of exemplary embodiments with reference to the attached drawings.

DESCRIPTION OF THE EMBODIMENTS

First Embodiment

An embodiment of an ink-jet printing apparatus will be described below. A printing apparatus of this embodiment is a high-speed line printer which uses a long continuous sheet (which is a continuous sheet that is longer than the length of a unit image in the direction of convey) wound on a roll and supports both one-side printing and duplex printing. The printing apparatus may be suitable for fields in which a large number of sheets are printed in printing laboratories, for example. The present invention is applicable to printing apparatuses such as a printer, a multifunctional printer, a copy machine, and a facsimile apparatus.

Figure 1:
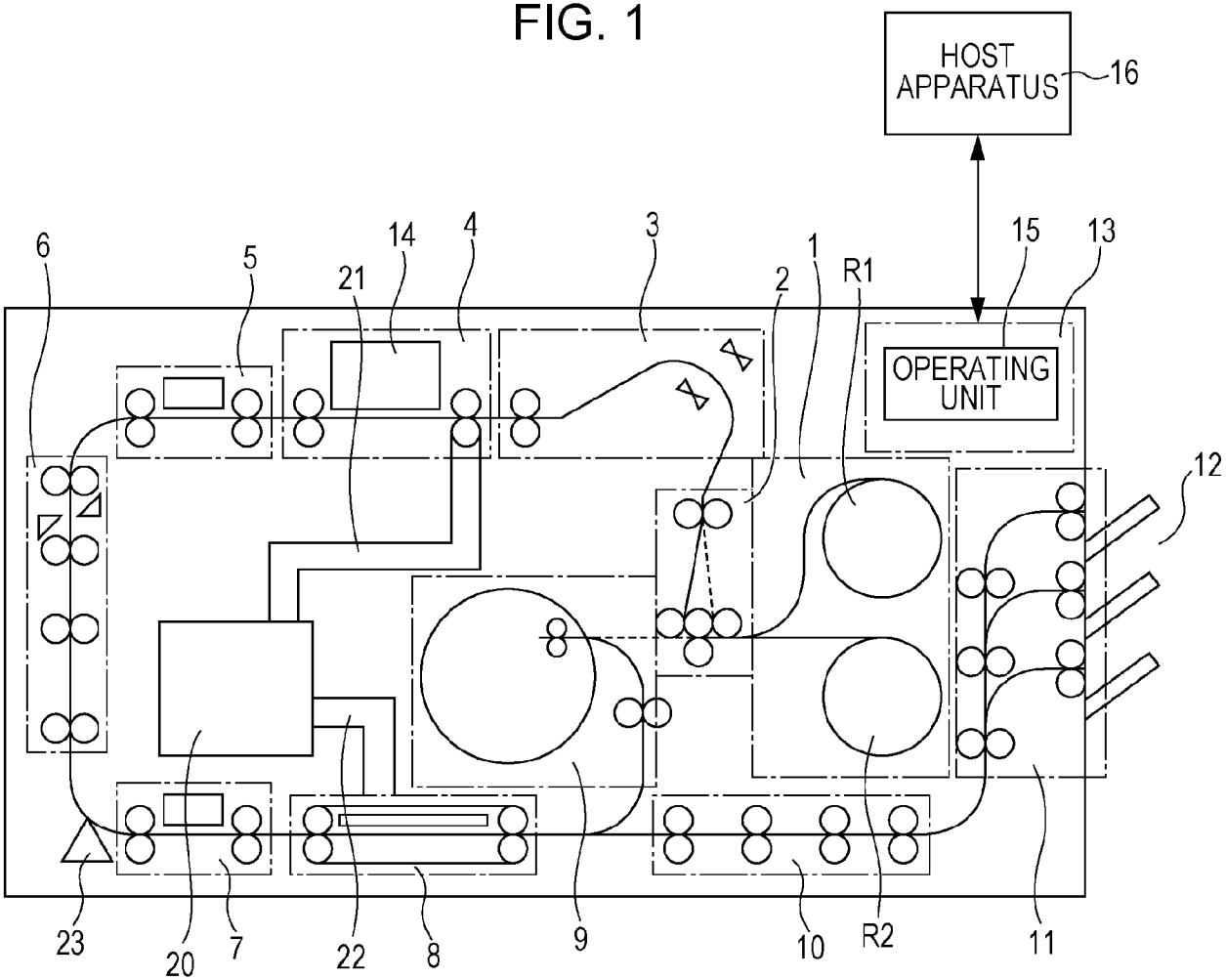
FIG. 1 is a schematic diagram illustrating an internal configuration of a printing apparatus.

FIG. 1 is a schematic diagram of a cross-section illustrating an internal configuration of a printing apparatus. A printing apparatus of this embodiment is capable of using a sheet wound on a roll and printing both sides of a first side and a second side which is the back side of the first side of the sheet. The printing apparatus internally contains units of, roughly, a sheet feeding unit 1, a de-curling unit 2, an oblique correcting unit 3, a printing unit 4, an examining unit 5, a cutter unit 6, an information recording unit 7, a drying unit 8, an reversing unit 9, a discharging/conveying unit 10, a sorter unit 11, a discharging part 12, a humidifying unit 20, and a control unit 13. A sheet is conveyed by a conveying mechanism including a pair of rollers and a belt along a sheet conveying path indicated by the illustrated solid line and is processed by these units.

The sheet feeding unit 1 holds and supplies a continuous sheet wound on a roll. The sheet feeding unit 1 is capable of accommodating two rolls R1 and R2 and alternatively draws and feeds a sheet. The number of rolls accommodatable therein is not limited to two but may be one or three or more.

The de-curling unit 2 reduces curl (warping) of a sheet fed from the sheet feeding unit 1. The de-curling unit 2 uses two pinch rollers for one driving roller to bend and allow a sheet to pass through such that warping in the opposite direction of the curl can be given to the sheet. Thus, a de-curling force can be applied to reduce the curl.

The oblique correcting unit 3 corrects an oblique (or tilt against the actual direction of travel) of a sheet passed through the de-curling unit 2. The oblique of a sheet may be corrected by pushing a sheet end on a reference side against a guide member.

The printing unit 4 performs printing processing on a conveyed sheet with a print head 14 from the upper part to form an image thereon. In other words, the printing unit 4 is a processing unit which performs a predetermined process on a sheet. The printing unit 4 includes a plurality of conveyor rollers which deliver a sheet. The print head 14 has a line print head having an ink-jet nozzle array in a range covering a maximum width assumed to use of a sheet. The print head 14 has a plurality of print heads in parallel in the direction of convey. According to this embodiment, seven print heads are provided for supporting seven colors of C (cyan), M (magenta), Y (yellow), LC (light cyan), LM (light magenta), G (gray) and K (black). The number of colors and the number of print heads are not limited to seven. The ink-jet system may use a heater element, a piezoelement, an electrostatic element, or an MEMS element, for example. The inks for those colors are supplied from ink tanks through respective ink tubes to the print head 14.

The examining unit 5 optically scans a test pattern or image printed on a sheet by the printing unit 4 with a scanner, examines a state of the nozzle of a print head, a sheet convey state, and an image position and determines whether the image is correctly printed or not. The scanner has a CCD image sensor or a CMOS image sensor.

The cutter unit 6 includes a mechanical cutter which cuts a printed sheet into a predetermined length. The cutter unit 6 further includes a plurality of convey rollers to feed a sheet to the next process.

The information recording unit 7 records print information (unique information) such as serial number and date printed in a non-print area of a cut sheet. The recording is performed by printing letter(s) or code by ink-jet or thermal transfer. A sensor 23 which detects the leading edge of a cut sheet is provided on the upstream side of the information recording unit 7 and the downstream side of the cutter unit 6. In other words, the sensor 23 detects an end of a sheet between the cutter unit 6 and a recording position by the information recording unit 7. On the basis of detection timing by the sensor 23, the timing for information recording by the information recording unit 7 is controlled.

The drying unit 8 heats a sheet printed in the printing unit 4 and dries the applied ink in a short time. Within the drying unit 8, hot air is applied to a passing sheet at least from the bottom side to dry the ink-applied surface. The method for drying is not limited to the application of hot air but may be the irradiation of electromagnetic waves (such as an ultraviolet ray and an infrared ray) to the sheet surface.

The sheet conveying path from the sheet feeding unit 1 to the drying unit 8 will be called a first path. The first path has a U-shape from the printing unit 4 to the drying unit 8, and the cutter unit 6 is positioned at some point of the U shape.

The reversing unit 9 temporarily winds a continuous sheet having undergone its surface printing for duplex printing and reverses the sheet. The reversing unit 9 is provided at some point in a path (loop path) from the drying unit 8 through the de-curling unit 2 to the printing unit 4 (called a second path) for feeding the sheet having passed through the drying unit 8 to the printing unit 4 again. The reversing unit 9 includes a winding rotary member (drum) which rotates for winding a sheet. A continuous sheet having its surface printed but not being cut is temporarily wound by the winding rotary member. After winding, the winding rotary member reverses. Thus, the wound sheet is supplied to the de-curling unit 2 and is fed to the printing unit 4. Since the sheet has been reversed, the printing unit 4 can print the back surface. The specific operations of the duplex printing will be described below.

The discharging/conveying unit 10 conveys the sheet cut by the cutter unit 6 and dried by the drying unit 8 and passes the sheet to the sorter unit 11. The discharging/conveying unit 10 is provided in a different path (called a third path) from the second path in the reversing unit 9. In order to selectively guide a sheet conveyed through the first path to either second path or third path, a path switching mechanism having a movable flapper is provided at a branch position of the paths.

The sorter unit 11 and discharging part 12 are provided on a side of the sheet feeding unit 1 and at an end of the third path. The sorter unit 11 sorts printed sheets into groups as required. The sorted sheets are discharged to the discharging part 12 having a plurality of trays. In this way, the third path has a layout in which a sheet can pass under the sheet feeding unit 1 and is discharged to the opposite side of the sheet feeding unit 1 from the printing unit 4 and drying unit 8.

The humidifying unit 20 generates humidified gas (air) and supplies the humidified gas to between the print head 14 of the printing unit 4 and a sheet. The supplied humidified gas can prevent the dry of ink in the nozzles of the print head 14. The humidifying unit 20 may humidify by vaporization, spraying, steaming or the like. The vaporization may be vapor permeation, sub-surface penetration or capillary vaporization instead of rotary vaporization. The spraying may be ultrasonic, centrifugal, high-pressure spraying, 2-fluid spraying or the like. The steaming may be steam piping, by heat transfer, of electrode type or the like. The humidifying unit 20 and printing unit 4 are connected through a first duct 21, and the humidifying unit 20 and drying unit 8 are connected through a second duct 22. The drying unit 8 generates high temperature and humidity gas in order to dry a sheet. The gas is guided through the second duct 22 to the humidifying unit 20 and is used as auxiliary energy for generation of humidified gas by the humidifying unit 20. The humidified gas generated by the humidifying unit 20 is guided through the first duct 21 to the printing unit 4.

The control unit 13 is responsible for control over components of the entire printing apparatus. The control unit 13 has a CPU, a storage device, a control unit including controllers, an external interface, and an operating unit 15 which is used for input/output from/to a user. The operations by the printing apparatus are controlled on the basis of an instruction from a host apparatus 16 which is a controller or a host computer connected to a controller through an external interface.

Figure 2:
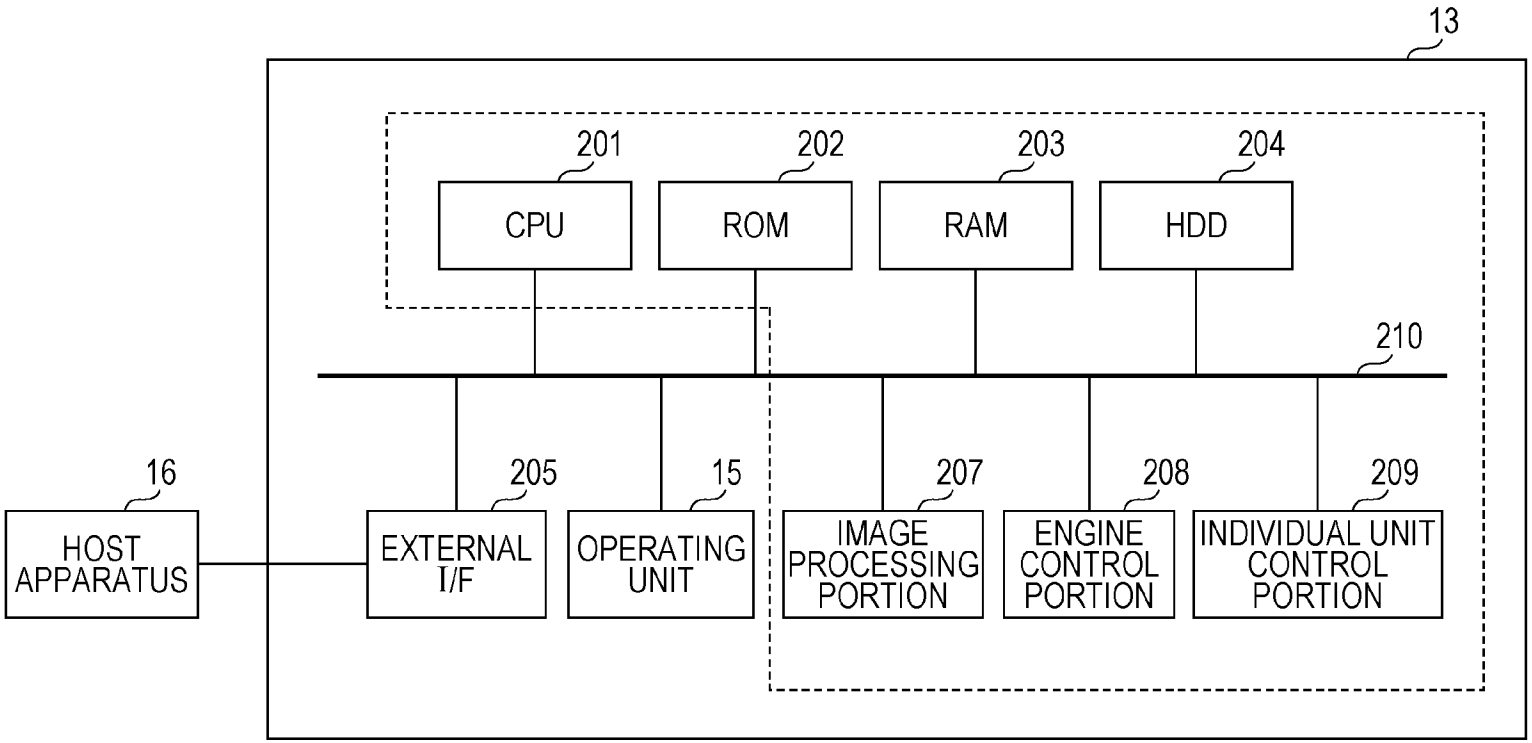
FIG. 2 is a block diagram of a control unit.

FIG. 2 is a block diagram illustrating a concept of the control unit 13. The controller (range enclosed by the broken line) included in the control unit 13 includes a CPU 201, a ROM 202, a RAM 203, an HDD 204, an image processing portion 207, an engine control portion 208, and an individual unit control portion 209. The CPU (central processing unit) 201 controls operations of units in the printing apparatus in a unified manner. The ROM 202 stores a program to be executed by the CPU 201 and fixed data that are necessary for operations by the printing apparatus. The RAM 203 may be used as a work area for the CPU 201 or as a temporary storage area for various received data and/or store setting data. The HDD (hard disk) 204 may store a program to be executed by the CPU 201, print data, and/or setting information that are necessary for operations by the printing apparatus, and these data may be read from the HDD 204. The operating unit 15 is a user input/output interface and includes an input unit such as a hard key and a touch panel and an output unit such as a display which provides information and a sound generator. For example, a display with a touch panel may be used to display to a user an operating status of the apparatus, a print condition, maintenance information (such as the remaining amount of ink, the remaining number of sheets, and a maintenance status). A user may also input information on the touch panel.

A unit required to perform high-speed data processing may include a special processing portion. An image processing portion 207 performs image processing on print data handled by the printing apparatus. The image processing portion 207 converts the color space (such as YCbCr) of input image data to the standard RGB color space (such as sRGB). The image processing portion 207 may further perform various kinds of image processing such as resolution conversion, image analysis, and image correction on image data. The print data acquired by the image processing may be stored in the RAM 203 or HDD 204. The engine control portion 208 may further control the driving of the print head 14 of the printing unit 4 in accordance with the print data on the basis of a control command received from the CPU 201, for example. The individual unit control portion 209 is a sub controller which individually controls the units of sheet feeding unit 1, de-curling unit 2, oblique correcting unit 3, examining unit 5, cutter unit 6, information recording unit 7, drying unit 8, reversing unit 9, discharging/conveying unit 10, sorter unit 11, discharging part 12, and humidifying unit 20. On the basis of an instruction from the CPU 201, the individual unit control portion 209 controls the operations by those units. The external interface 205 connects the control unit 13 to the host apparatus 16 and may be a local I/F or a network I/F. These components are connected via a system bus 210.

The host apparatus 16 supplies image data to print by the printing apparatus. The host apparatus 16 may be a general-purpose or special computer or may be a special image apparatus such as an image capture with an image reader, a digital camera, and a photo storage. If the host apparatus 16 is a computer, an OS, application software which generates image data, and a print driver for a printing apparatus are installed in a storage device included in the computer. All of the processes above are not required to implement by software, but a part or all of them may be implemented by hardware.

Next, basic operations for printing will be described. The operations for printing differ between one-side printing mode and duplex printing mode and will be described separately.

Figure 3:
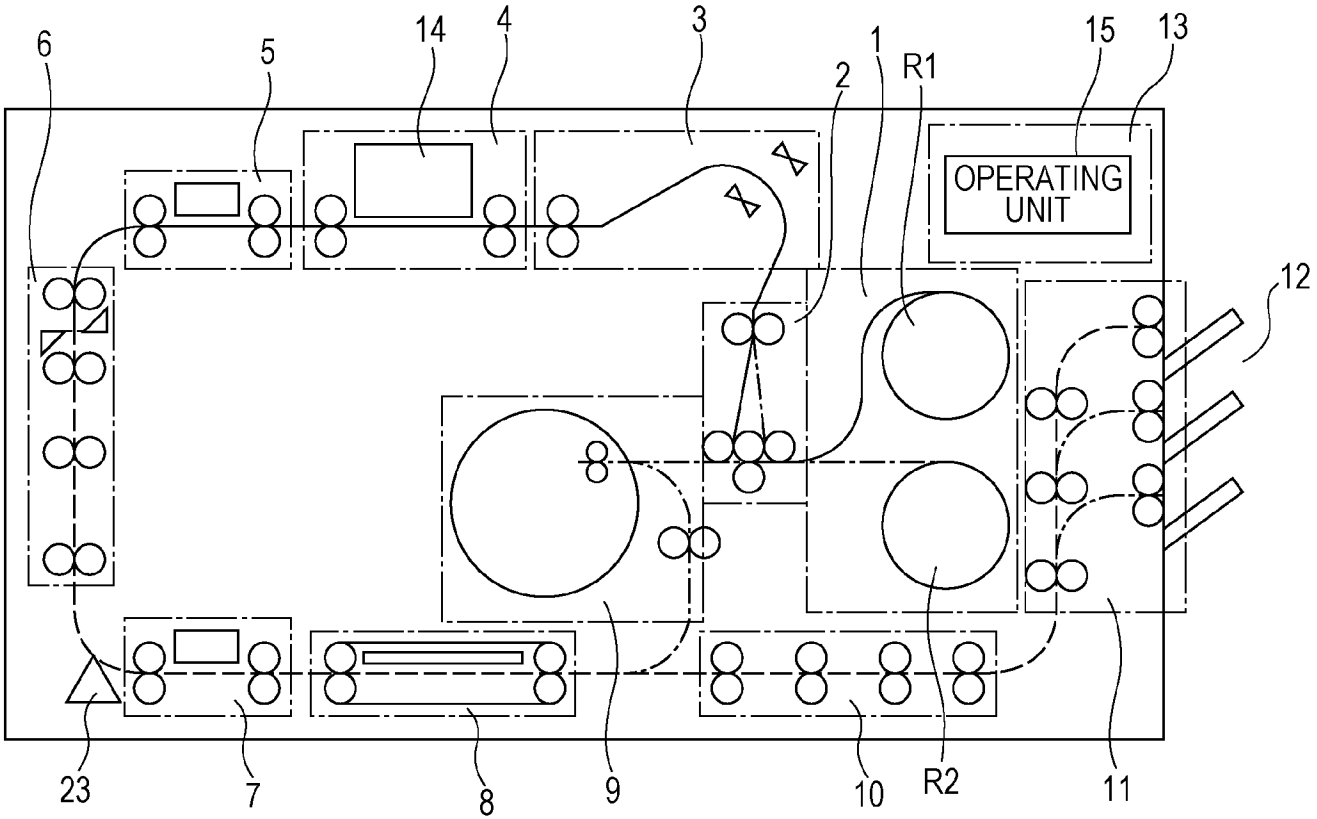
FIG. 3 is a diagram for illustrating an operation in a one-side printing mode.

FIG. 3 is a diagram for illustrating an operation in a one-side printing mode. The thick line indicates a conveying path in which a sheet supplied from the sheet feeding unit 1 is printed and is then discharged to the discharging part 12. A sheet supplied from the sheet feeding unit 1 and processed by the de-curling unit 2 and oblique correcting unit 3 has its surface (first side) printed by the printing unit 4. An image (unit image) having a predetermined unit length is sequentially printed on a long continuous sheet in the direction of convey, forming a plurality of images thereon. The printed sheet passes through the examining unit 5 and is cut by the cutter unit 6 into the unit images. The cut sheets have their back sides recorded with print information by the information recording unit 7, as required. The cut sheets are conveyed to and are dried by the drying unit 8 one by one. After that, the sheets pass through the discharging/conveying unit 10, are sequentially discharged to the discharging part 12 of the sorter unit 11 and are piled up. On the other hand, the sheet left in the printing unit 4 after the cut of the last unit image is fed back to the sheet feeding unit 1, and the sheet is wound on the roll R1 or R2. In this way, in the one-side printing mode, a sheet passes through the first path and third path and is processed there but does not pass through the second path.

Figure 4:
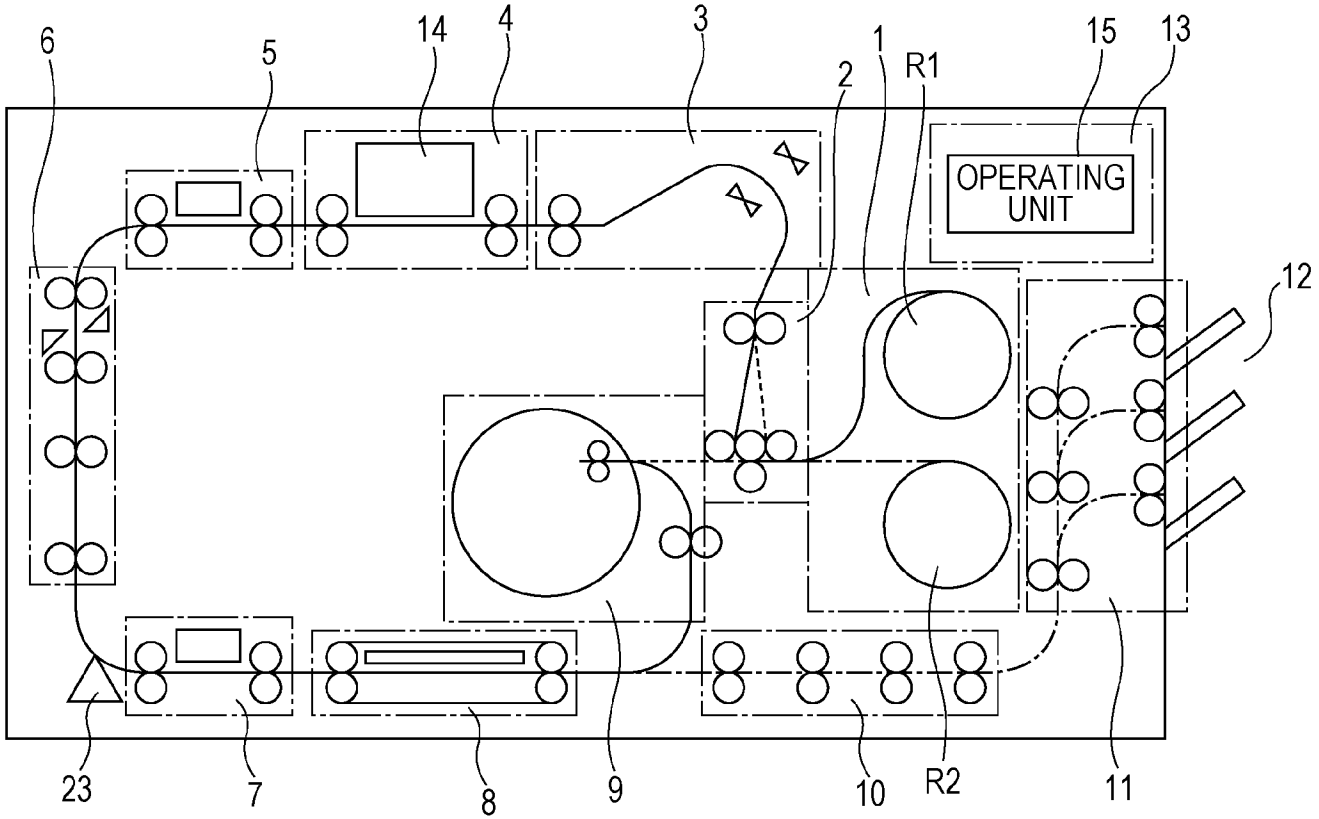
FIG. 4 is a diagram for illustrating an operation in a duplex printing mode.

FIG. 4 is a diagram for illustrating an operation in a duplex printing mode. In a duplex printing mode, the surface (first side) printing sequence is followed by a back surface (second side) printing sequence. In the front surface printing sequence in the beginning, the operations in the units from the sheet feeding unit 1 to the examining unit 5 are the same as the operations in the one-side printing mode. Without the cutting operation into a unit length in the cutter unit 6, a continuous sheet is directly conveyed to the drying unit 8. After drying the ink on the surface by the drying unit 8, the sheet is guided to the path (second path) on the reversing unit 9 side, instead of the path (third path) on the discharging/conveying unit 10 side. In the second path, the sheet is wound by the winding rotary member of the reversing unit 9 which rotates in the forward direction (which is the counter-clockwise direction in FIG. 4). When a planned surface printing is all finished in the printing unit 4, the cutter unit 6 cuts the rear end of the printed area of the continuous sheet. With reference to the cut position, the continuous sheet on the downstream side (printed side) in the direction of convey passes through the drying unit 8 and is all wound by the reversing unit 9 up to the rear end (cut position) of the sheet. On the other hand, upon wound, the continuous sheet left on the upstream side (printing unit 4 side) in the direction of convey from the cut position is wound back to the sheet feeding unit 1 such that the leading end of the sheet (cut position) may not be left in the de-curling unit 2. Then, the sheet is wound on the roll R1 or R2. The winding back can prevent the collision between the sheet and the sheet supplied again in the following back surface printing sequence.

The front surface printing sequence is followed by back surface printing sequence. The winding rotary member of the reversing unit 9 rotates in the opposite direction (in the clockwise direction in FIG. 4) of that in winding. The end (which is the rear end of the sheet in winding and is the leading end of the sheet in feeding) of the wound sheet is fed to the de-curling unit 2 through the path indicated by the illustrated broken line. The de-curling unit 2 corrects the curl given by the winding rotary member. In other words, the de-curling unit 2 is provided between the sheet feeding unit 1 and the printing unit 4 in the first path and between the reversing unit 9 and the printing unit 4 in the second path and is a common unit which de-curls in either path. The reversed sheet is fed through the oblique correcting unit 3 to the printing unit 4, and the back surface of the sheet is printed. The printed sheet passes through the examining unit 5 and is cut in predetermined unit lengths by the cutter unit 6. Since the cut sheet have its both sides printed, it is not recorded in the information recording unit 7. The cut sheets are conveyed to the drying unit 8 one by one, pass through the discharging/conveying unit 10, are sequentially discharged to the discharging part 12 of the sorter unit 11 and are piled up. In this way, in the duplex printing mode, a sheet passes through the first path, second path or first path and third path sequentially to undergo the processing.

Figure 5:
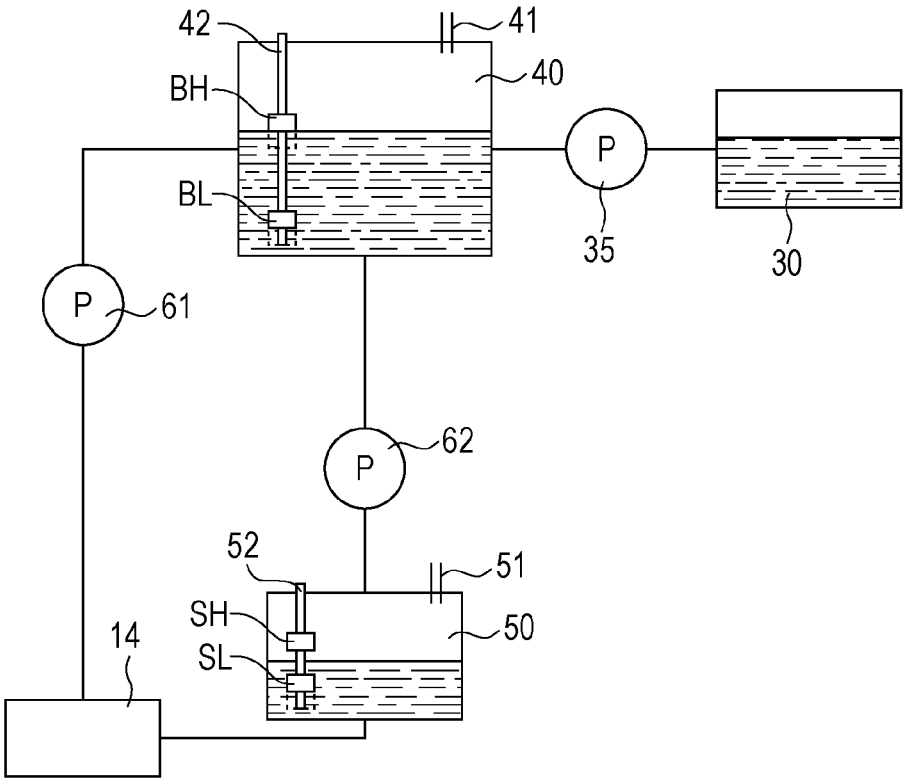
FIG. 5 illustrates an ink circulation/supply mechanism according a first embodiment.

FIG. 5 illustrates an ink circulation/supply mechanism according to the first embodiment. As described above, according to this embodiment, seven print heads for C (cyan), M (magenta), Y (yellow), LC (light cyan), LM (light magenta), G (gray), and K (black) are provided. Since the ink circulation/supply mechanism has the same configuration for each color, FIG. 5 only illustrates the ink circulation/supply mechanism for one color.

Referring to FIG. 5, an ink tank 30 holds ink to be supplied to the corresponding print head. The ink tank 30 is removably attached to the main body of the printing apparatus. A buffer tank 40 is a first storage tank which receives ink from the ink tank 30 first. A sub tank 50 is a second storage tank which receives ink from the buffer tank 40. Ink is supplied from the sub tank 50 to the print head 14.

The buffer tank 40 is provided at the highest position in the ink circulation/supply path. The print head 14 changes its position vertically when printing a sheet and when performing a recovery operation. The sub tank 50 is provided at a position so as to prevent ink drop from the nozzle of the print head 14 or air influx to the nozzle wherever the print head 14 positions.

A supply pump 35 functions to supply ink from the ink tank 30 to the buffer tank 40. A first circulation pump 61 is provided in a circulation supply path between the print head 14 and the buffer tank 40. The first circulation pump 61 is driven so that the ink stored in the sub tank 50 can be supplied to the print head 14 and the ink not used by the print head 14 for printing is collected to the buffer tank 40. A second circulation pump 62 is provided in a circulation supply path between the buffer tank 40 and the sub tank 50. The second circulation pump 62 is driven so that the ink stored in the buffer tank 40 is supplied to the sub tank 50.

The first circulation pump 61, second circulation pump 62, and supply pump 35 are tube pumps which are rotary-driven by squeezing their tubes through rollers to generate pressure. These pumps are driven by a stepping motor.

An air vent 41 is provided at an upper part of the buffer tank 40. Through the air vent 41, bubbles accumulated within the buffer tank 40 are discharged to the outside of the tank. A buffer tank sensor 42 is a second liquid-level detecting unit (second detecting unit). The buffer tank sensor 42 includes an axis fixed to the buffer tank 40 and a buffer-tank higher float BH and buffer-tank lower float BL through which the axis extends and which are movable vertically within a predetermined range. The buffer-tank higher float BH and buffer-tank lower float BL have a higher density than air and a lower density than ink. Thus, when the liquid level of ink is higher than the floats, the floats move upward. However, a regulating unit controls the upward movement of the floats at a predetermined position. When the liquid level of ink is lower than the floats, the float moves downward. However, the regulating unit controls the downward movement of the float at a predetermined position. The axis internally contains a magnetic switch. When the floats move in the direction of height in accordance with the height of the liquid level, the magnetic switch detects the positions of the buffer-tank higher float BH and buffer-tank lower float BL and thus can detect the position of the liquid level of ink.

An air vent 51 is provided at an upper part of the sub tank 50. Through the air vent 51, bubbles accumulated within the sub tank 50 are discharged to the outside of the tank. A sub tank sensor 52 is a first liquid-level detecting unit. The sub tank sensor 52 includes an axis, and sub tank higher float SH, and sub tank lower float SL like the buffer tank sensor 42.

According to this embodiment, the liquid level detecting unit includes the buffer tank sensor 42 and sub tank sensor 52 for the following description. However, the liquid level detecting unit may have other structures. For example, electrostatic capacity sensor may be placed on both sides of a tank, and the electrostatic capacity sensor may detect the position of the liquid level on the basis of the state of a change in potential in the sensor.

The amount of ink stored in the buffer tank 40 is higher than the amount of ink stored in the sub tank 50. The ink capacity from the buffer-tank lower float BL to the buffer-tank higher float BH in the buffer tank sensor 42 is higher than the ink capacity from the sub tank lower float SL to the sub tank higher float SH in the sub tank sensor 52.

Figure 6A:
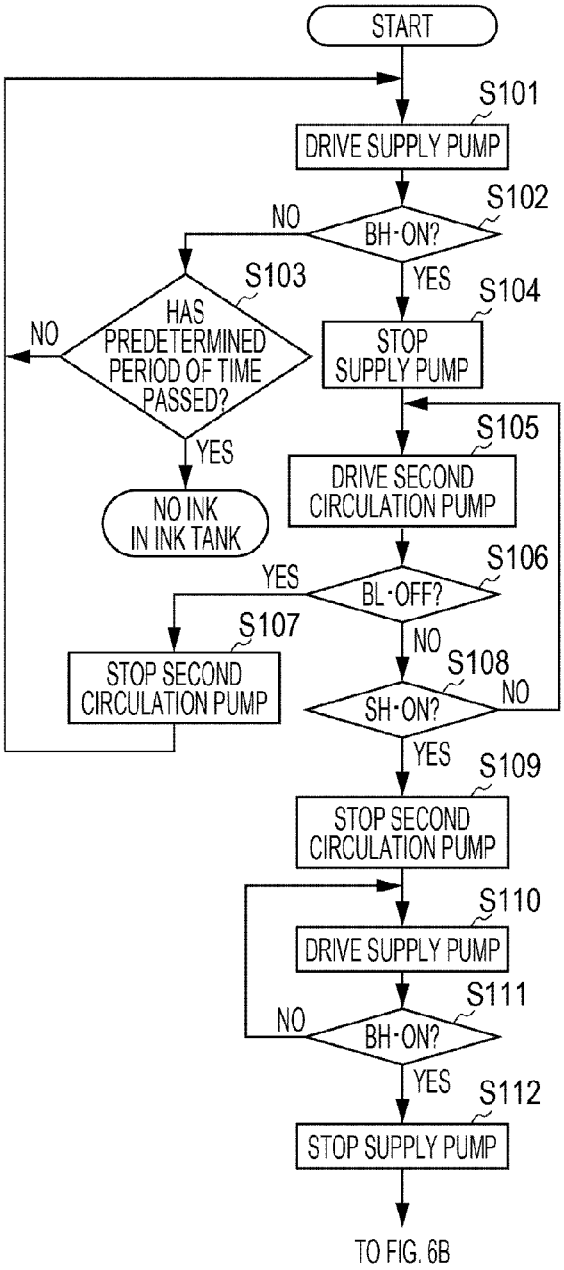
FIGS. 6A and 6B are flowcharts describing operations for filling ink from an ink tank to a print head.
Figure 6B:
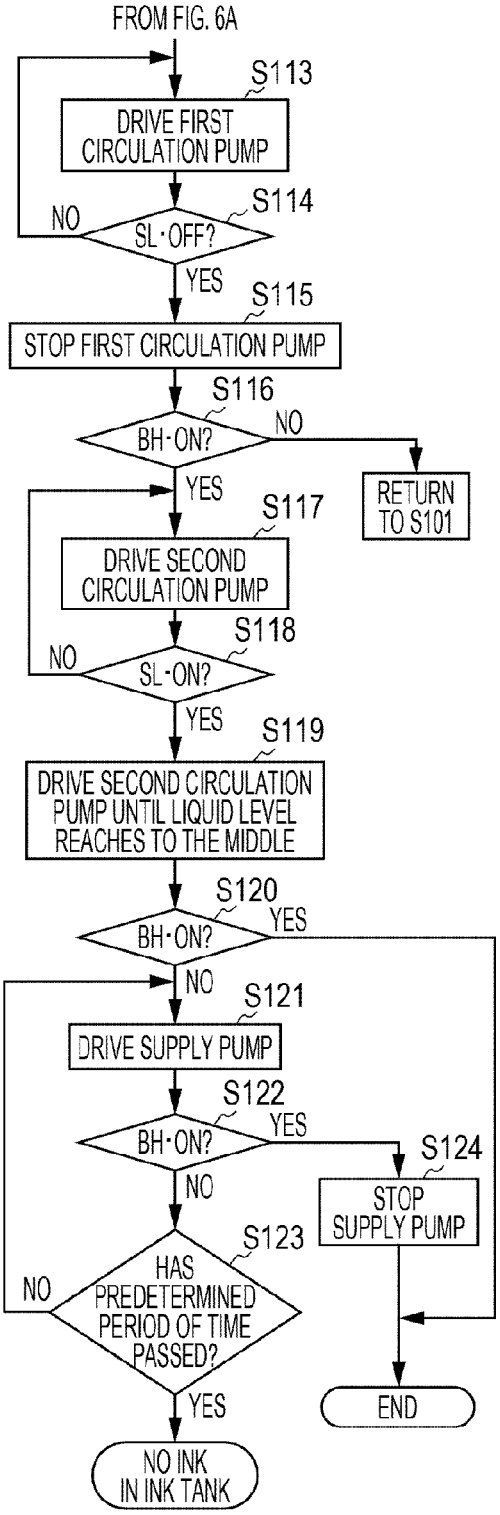

Next, an operation for filling ink from the ink tank 30 to the print head 14 will be described. FIGS. 6A and 6B are flowcharts describing an operation for filling ink from an ink tank to a print head. FIGS. 7A to 7E illustrate operations for filling ink from an ink tank to a print head.

Figure 7A:
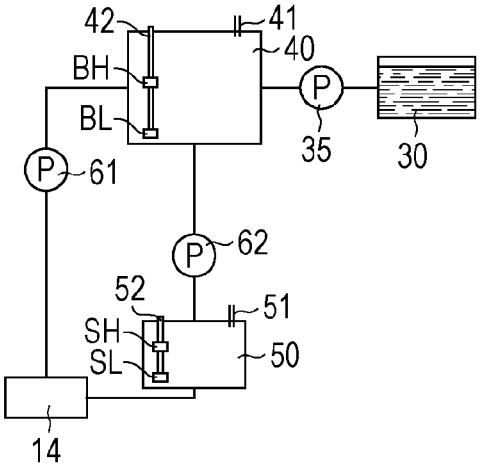
FIGS. 7A to 7E illustrate operations for filling ink from an ink tank to a print head.

Referring to FIG. 6A, an ink filling operation starts in START. FIG. 7A illustrates a state before start of the ink filling operation. In this state, the buffer tank 40 is out of ink, the buffer-tank higher float BH and buffer-tank lower float BL are at the lowest part of their movable ranges. Since the sub tank 50 is also out of ink, the sub tank higher float SH and sub tank lower float SL are at the lowest part of their movable ranges.

In step S101, the supply pump 35 is driven. Driving the supply pump 35 causes the ink stored in the ink tank 30 to be supplied to the buffer tank 40. When ink is started to supply to the buffer tank 40, the liquid level rises and the buffer-tank lower float BL at the lowest part of its movable range thus rises. Then, the detection of the buffer-tank lower float BL is switched from the OFF state to the ON state. When ink is supplied from the ink tank 30 to the buffer tank 40, the buffer-tank higher float BH at the lowest part of its movable range rises, and the detection of the buffer-tank higher float BH is switched from the OFF state to the ON state.

Figure 7B:
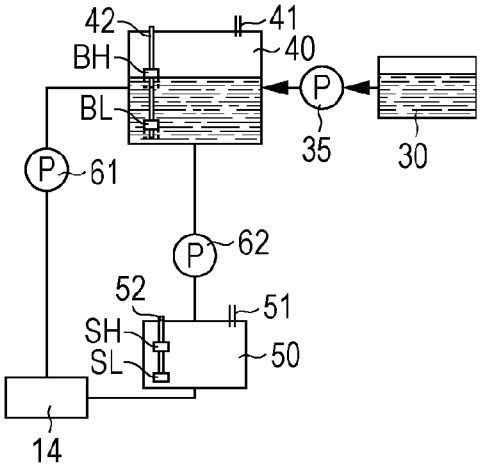

In step S102, whether the detection of the buffer-tank higher float BH has been switched from the OFF state to the ON state or not is detected. If it is detected in step S102 that the detection of the buffer-tank higher float BH has been switched to the ON state, the driving of the supply pump 35 is stopped in step S104. FIG. 7B illustrates the state that the driving of the supply pump 35 has stopped as a result of the switching of the detection of the buffer-tank higher float BH to the ON state.

In step S103, even when the supply pump 35 is driven for a predetermined period of time but the buffer-tank higher float BH is not switched to the ON state, it is determined that no ink is available within the ink tank 30. Thus, the necessity for replacement of the ink tank 30 is notified.

Figure 7C:
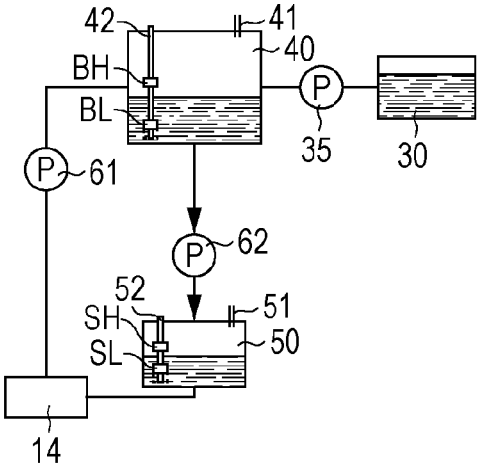

After the driving of the supply pump 35 stops in step S104, the second circulation pump 62 is driven in step S105. Driving the second circulation pump 62 causes the ink stored in the buffer tank 40 to be supplied to the sub tank 50. When ink is started to supply to the sub tank 50, the liquid level rises and the sub tank lower float SL at the lowest part of its movable range thus rises. Therefore, the detection of the sub tank lower float SL is switched from the OFF state to the ON state. When ink is supplied from the buffer tank 40 to the sub tank 50, the sub tank higher float SH at the lowest part of its movable range thus rises. Therefore, the detection of the sub tank higher float SH is switched from the OFF state to the ON state. FIG. 7C illustrates a state while ink is being supplied from the buffer tank 40 to the sub tank 50. In the state, the amount of ink within the buffer tank 40 is decreasing, and the amount of ink within the sub tank 50 is increasing.

If it is detected in step S106 that the detection of the buffer-tank lower float BL in the buffer tank 40 is switched from the ON state to the OFF state before the detection of the buffer-tank higher float BH is switched to the ON state and the sub tank higher float SH is switched to the ON state in step S104, the driving of the second circulation pump 62 stops in step S107. Returning to step S101, the supply pump 35 is driven, and ink is supplied from the ink tank 30 to the buffer tank 40. If it is detected in step S106 that the detection of the buffer-tank lower float BL has not been switched to the OFF state and it is detected in step S108 that the detection of the sub tank higher float SH has been switched to the ON state, the driving of the second circulation pump 62 stops in step S109.

Figure 7D:
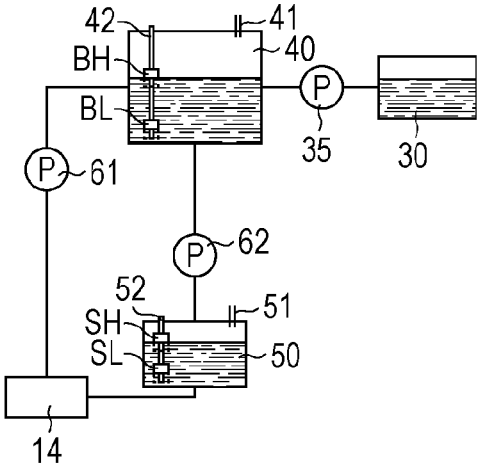

The driving of the second circulation pump 62 and the supply of ink from the buffer tank 40 to the sub tank 50 reduces the amount of ink in the buffer tank 40. Thus, in step S110, the supply pump 35 is driven. In step S111, whether the buffer-tank higher float BH in the buffer tank 40 has been switched from the OFF state to the ON state or not is detected. If it is detected that the detection of the buffer-tank higher float BH has been switched to the ON state, the driving of the supply pump 35 stops in step S112. FIG. 7D illustrates the state that ink is supplied from an ink tank until the detection of the buffer-tank higher float BH1 is switched to the ON state. These operations can fill ink in the buffer tank 40 and sub tank 50.

Next, with reference to FIG. 6B, the operation will be described for filling ink to a channel from the sub tank 50 to the print head 14, a liquid chamber within the print head 14, and a channel from the print head 14 to the buffer tank 40. In step S113, the first circulation pump 61 is driven. Driving the first circulation pump 61 causes the ink stored in the sub tank 50 to be supplied to the print head 14. In step S114, whether the detection of the sub tank lower float SL in the sub tank 50 has been switched from the ON state to the OFF state or not is detected. If it is detected that the sub tank lower float SL has been switched to the OFF state, the driving of the first circulation pump 61 stops in step S115.

In step S116, whether the buffer-tank higher float BH in the buffer tank 40 has the ON state or not is detected. If the buffer-tank higher float BH does not have the ON state, the processing returns to step S101 where the supply pump 35 is driven to supply ink from the ink tank 30 to the buffer tank 40. If the buffer-tank higher float BH has the ON state, the second circulation pump 62 is driven in step S117. In step S118, whether the sub tank lower float SL in the sub tank 50 has been switched from the OFF state to the ON state or not is detected. If it is detected that the sub tank lower float SL has been switched to the ON state, the second circulation pump 62 is driven by a predetermined amount. The liquid level in the sub tank 50 is set to a position between the sub tank lower float SL and the sub tank higher float SH.

Figure 7E:
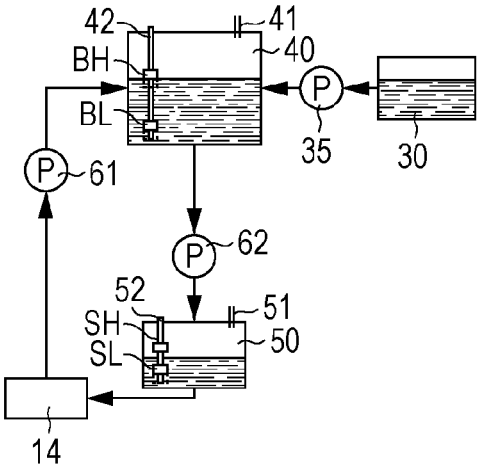

Next, in step S120, whether the buffer-tank higher float BH in the buffer tank 40 has the ON state or not is detected. If the buffer-tank higher float BH has the ON state, the ink filling operation ends. If the buffer-tank higher float BH has the OFF state, the supply pump 35 is driven in step S121. In step S122, whether the buffer-tank higher float BH in the buffer tank 40 has been switched from the OFF state to the ON state or not is detected. If it is detected in step S122 that the buffer-tank higher float BH has been switched to the ON state, the driving of the supply pump 35 stops in step S124, and the ink filling operation ends. FIG. 7E illustrates a state that the liquid level in the, sub tank 50 is a middle liquid level and ink is being supplied from the ink tank until the buffer-tank higher float BH in the buffer tank 40 is switched to the ON state.

In step S123, if the buffer-tank higher float BH is not switched to the ON state even when the supply pump 35 is driven for a predetermined period of time, it is determined that no ink is available within the ink tank 30, and the necessity for replacement of the ink tank 30 is notified.

Performing the ink filling operation as described above can keep the state that ink is properly available in the buffer tank 40 and sub tank 50 and at the same time allows filling ink to an ink circulation/supply path. Performing the ink filling operation also prevent easy occurrence of bubbles within an ink circulation/supply path.

Figure 8:
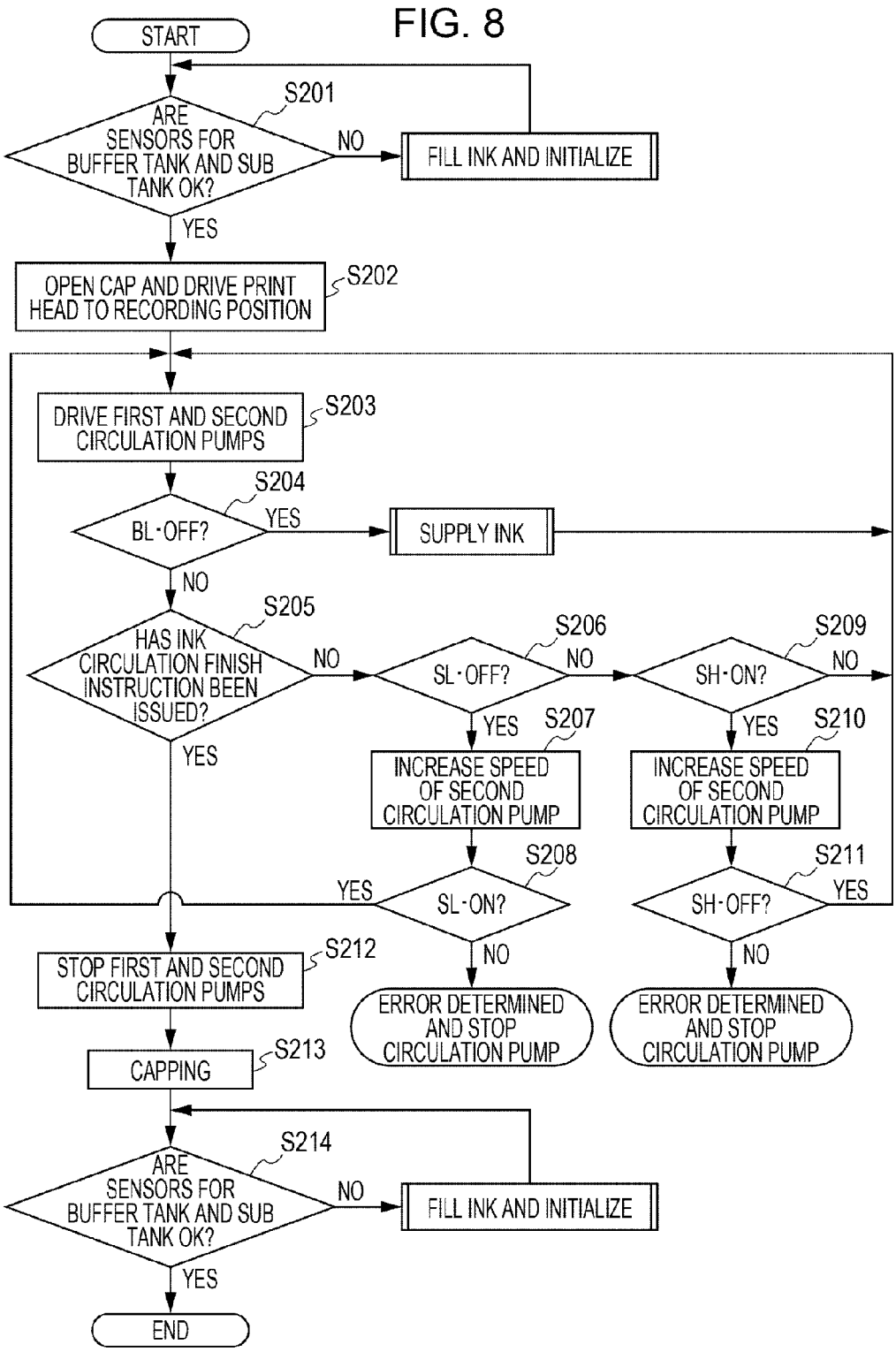
FIG. 8 is a flowchart describing an operation for circulating ink.
Figure 9:
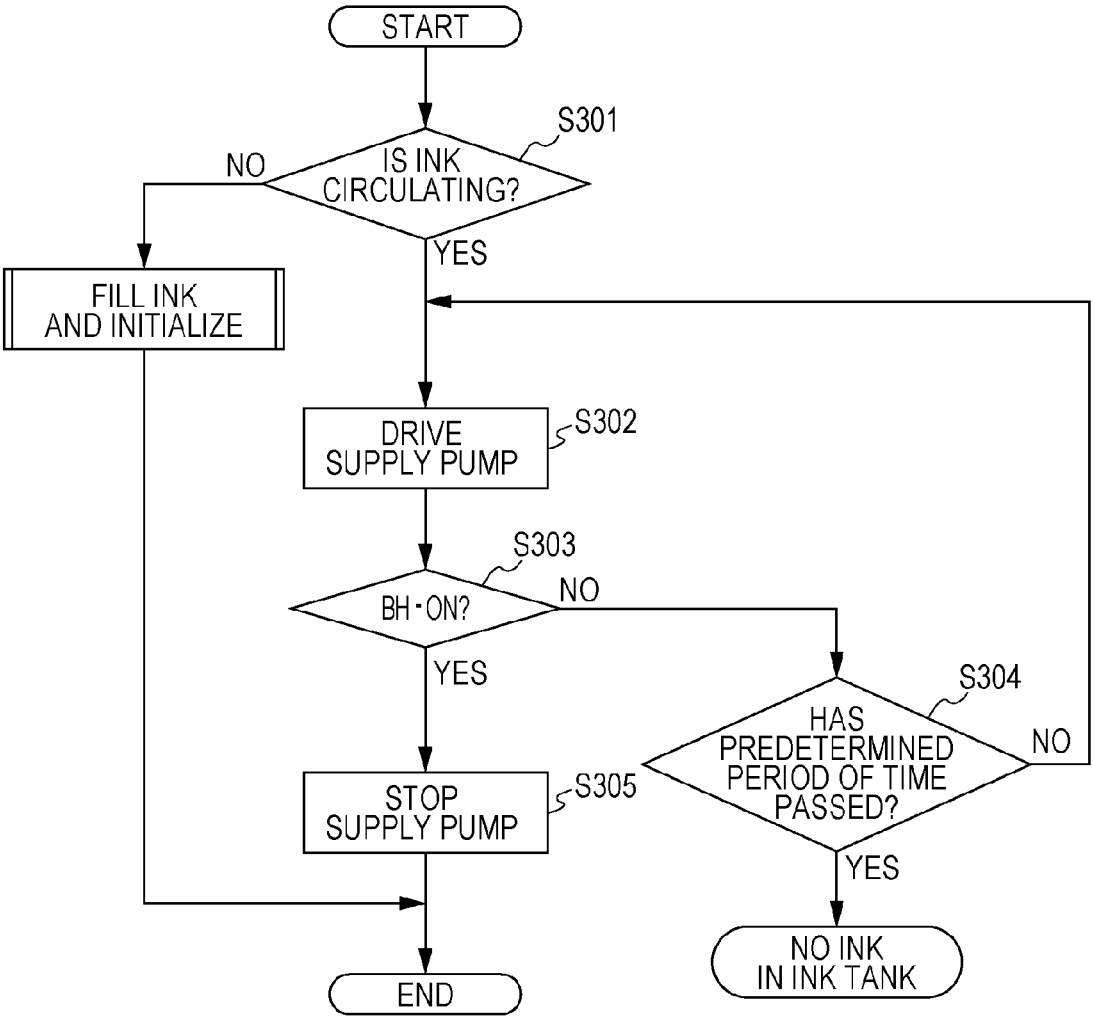
FIG. 9 is a flowchart describing an operation for supplying ink from an ink tank.
Figure 10A:
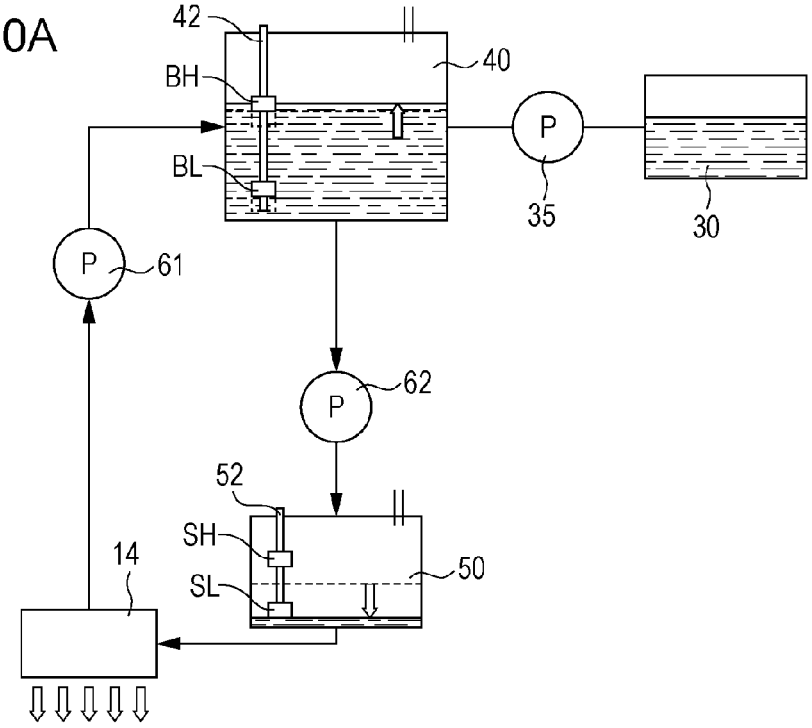
FIGS. 10A and 10B illustrate an operation for circulating ink.
Figure 10B:
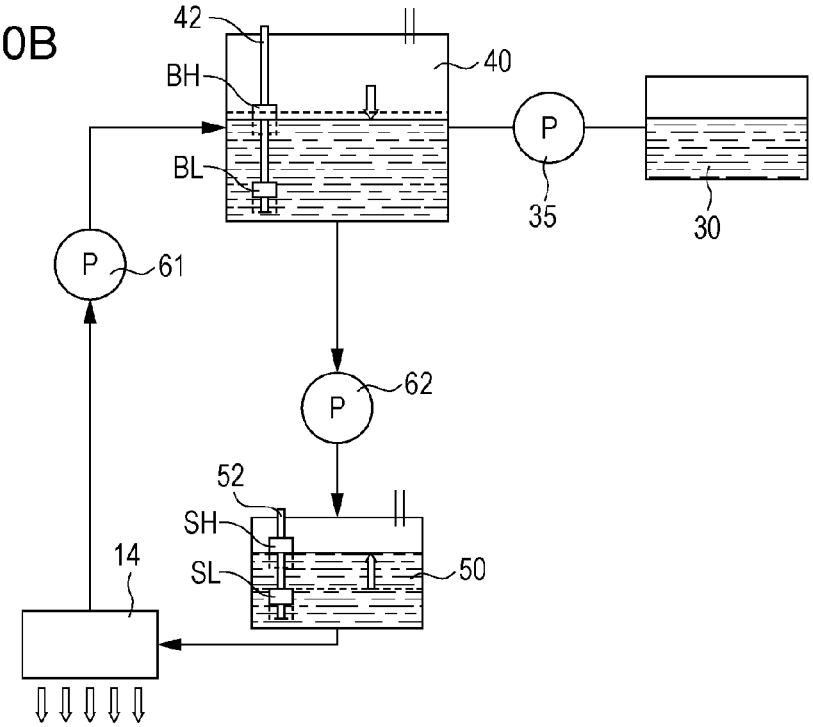

Next, an operation for circulating ink within an ink circulation/supply path will be described. FIG. 8 is a flowchart describing an operation for circulating ink. FIG. 9 is a flowchart describing an operation for supplying ink from an ink tank. FIGS. 10A and 10B illustrate an operation for circulating ink.

Referring to FIG. 8, an ink circulation operation start in START. In step S201, the states of the floats in the buffer tank 40 and sub tank 50 are checked. In other words, whether the buffer-tank higher float BH has the ON state and the buffer-tank lower float BL has the ON state in the buffer tank 40 or not is checked. Whether the sub tank higher float SH has the OFF state and the sub tank lower float SL has the ON state in the sub tank 50 or not is further checked. Under the states, the ink circulation operation in and after step S202 starts. If they do not have the states, the ink filling operation described in FIG. 6 is performed.

In step S202, a cap is opened, and the print head 14 is moved to a print position. Next, in step S203, the first circulation pump 61 and second circulation pump 62 are driven. Starting the driving of the first circulation pump 61 and second circulation pump 62 starts ink circulation within an ink circulation/supply path. Here, in order to stabilize ink ejection from the print head 14, the first circulation pump 61 which supplies ink to the print head 14 is driven at a constant speed.

When ink is ejected from the print head 14 for a printing operation, the ink within the buffer tank 40 decreases. Even when the print head 14 is not ejecting ink, the different amounts of circulated ink within the first circulation pump 61 and second circulation pump 62 may change the liquid levels in the buffer tank 40 and sub tank 50. According to the present invention, liquid levels therein are detected with the sub tank higher float SH and sub tank lower float SL. Thus, the driving speed for the second circulation pump 62 can be controlled such that the liquid level in the sub tank 50 can position between the sub tank higher float SH and the sub tank lower float SL.

In step S204, whether the buffer-tank lower float BL in the buffer tank 40 has the OFF state or not is detected. Performing ink ejection from the print head 14 and ink circulation operation continuously reduces the amount of ink within the buffer tank 40. First of all, the buffer-tank higher float BH is switched from the ON state before the ink circulation operation starts to the OFF state. Performing the ink ejection from the print head 14 and ink circulation operation continuously further reduces the amount of ink within the buffer tank 40, switching the buffer-tank lower float BL to the OFF state. When the buffer-tank lower float BL has the OFF state, an ink supply operation is performed.

With reference to FIG. 9, the ink supply operation will be described below. Referring to FIG. 9, the ink supply operation starts in START.

In step S301, whether the ink circulation operation is being performed or not is determined. If the ink circulation operation is not being performed, the ink filling operation described in FIG. 6 is performed, and the ink supply operation ends. If the ink circulation operation is being performed, the supply pump 35 is driven in step S302. Driving the supply pump 35 causes the ink stored in the ink tank 30 to be supplied to the buffer tank 40. In step S303, whether the buffer-tank higher float BH in the buffer tank 40 has been switched to the ON state or not is detected. If it is detected that the buffer-tank higher float BH has been switched to the ON state, the driving of the supply pump 35 stops in step S304, and the ink supply operation ends. The amount of ink for each unit time to be supplied from the ink tank 30 to the buffer tank 40 with the supply pump 35 is higher than the amount of ink for each unit time ejected from the print head 14 for a printing operation.

In step S304, if the buffer-tank higher float BH has not been switched to the ON state even after the supply pump 35 is driven for a predetermined period of time, it is determined that no ink is available within the ink tank 30. Thus, the necessity for replacement of the ink tank 30 is notified. If it is determined that no ink is available within the ink tank 30, the printing operation and ink circulation operation continue. If it is detected that the buffer-tank lower float BL in the buffer tank 40 has the OFF state, processing of aborting the current printing operation at a separator in a print instruction is performed. More specifically, after the switching of the buffer-tank lower float BL in the buffer tank 40 from ON to OFF is detected and when a printing operation is performed with the amount of ink to the application limit of the ink within buffer tank 40, the printing operation is aborted.

Referring back to FIG. 8, the ink circulation operation will further be described. If it is detected in step S204 that the buffer-tank lower float BL has the ON state, whether an instruction to finish the ink circulation has been issued or not is determined in step S205.

If it is determined in step S205 that no instruction to finish the ink circulation has been issued, whether the sub tank lower float SL in the sub tank 50 has the OFF state or not is detected in step S206. FIG. 10A illustrates a state of an ink circulation/supply path when the sub tank lower float SL has the OFF state. When the sub tank lower float SL has the OFF state, the driving speed for the second circulation pump 62 is increased in step S207. In other words, if it is detected that the amount of ink within the sub tank 50 is lower than a first threshold value, the driving speed for the second circulation pump 62 is increased. Increasing the driving speed for the second circulation pump 62 increases the amount of ink to be supplied from the buffer tank 40 to the sub tank 50. Thus, a rise of the liquid level of the ink may be expected. After a lapse of a predetermined period of time, whether the sub tank lower float SL has been switched to the ON state or not is detected in step S208. If it is detected that the sub tank lower float SL has been switched to the ON state, the processing returns to step S203, and the ink circulation operation continues. When the sub tank lower float SL is not switched to the ON state even after a lapse of the predetermined period of time, the occurrence of an error is determined. Thus, the driving of the first circulation pump 61 and second circulation pump 62 stops.

If it is detected that the sub tank lower float SL has the ON state in step S206, whether the sub tank higher float SH has the ON state or not is detected in step S209. FIG. 10B illustrates a state of the ink circulation/supply path when the sub tank higher float SH has the ON state. When the sub tank higher float SH has the ON state, the driving speed for the second circulation pump 62 is reduced in step S210. In other words, if it is detected that the amount of ink within the sub tank 50 is higher than a second threshold value that is higher than the first threshold value, the driving speed for the second circulation pump 62 is reduced. Reducing the driving speed for the second circulation pump 62 reduces the amount of ink supplied from the buffer tank 40 to the sub tank 50. Thus, a fall of the liquid level of the ink in the sub tank 50 may be expected. After a lapse of a predetermined period of time, whether sub tank higher float SH has been switched to the OFF state or not is detected in step S211. If it is detected that the sub tank higher float SH has been switched to the OFF state, the processing returns to step S203, and the ink circulation operation continues. When the sub tank higher float BH is not switched to the OFF state even after a lapse of the predetermined period of time, the occurrence of an error is determined, and the driving of the first circulation pump 61 and second circulation pump 62 stops. If it is detected in step S209 that the sub tank higher float SH has the OFF state, the processing returns to step S203, and the ink circulation operation continues.

In accordance with an instruction to finish the ink circulation in step S205, the driving of the first circulation pump 61 and second circulation pump 62 stops in step S212. In step S213, the print head 14 is capped. In step S214, the states of the floats in the buffer tank 40 and sub tank 50 are checked. In other words, whether the buffer-tank higher float BH in the buffer tank 40 has the ON state and the buffer-tank lower float BL has the ON state or not is checked. Whether the sub tank higher float SH in the sub tank 50 has the OFF state and the sub tank lower float SL has the ON state or not is further checked. Under the states, the ink circulation operation ends. If they do not have the states, the ink filling operation described in FIG. 6 is performed. Then, the ink circulation operation ends.

Figure 11:
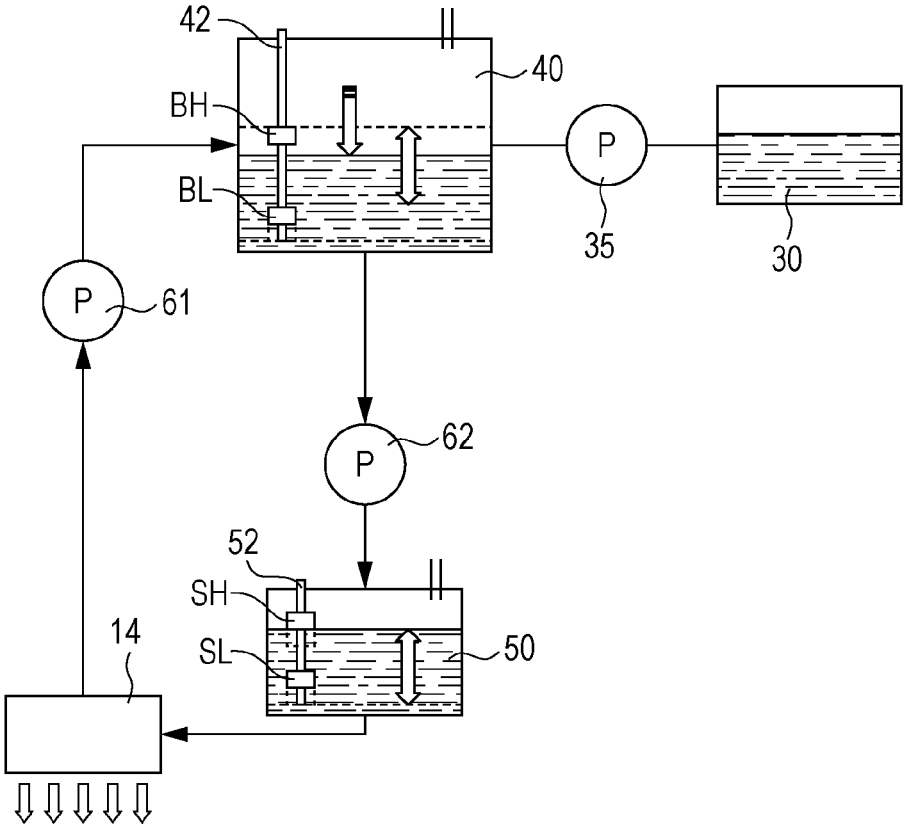
FIG. 11 is a conceptual diagram of ink circulation/supply control.

FIG. 11 is a conceptual diagram of the ink circulation/supply control having described up to this point. According to this embodiment, the liquid level in the sub tank 50 is controlled between the sub tank higher float SH and the sub tank lower float SL. With a change in liquid level in the sub tank 50, the liquid level in the buffer tank 40 repeats rising and falling and gradually falls as a result of consumption of ink ejected from the print head 14. After that, when the ink within the ink circulation/supply path has been securely consumed is determined on the basis of the detection results by the first liquid-level detecting unit and second liquid-level detecting unit, the supply pump 35 is driven to supply ink from the ink tank 30 to the buffer tank 40.

According to this embodiment, a buffer tank float sensor (second detecting unit) monitors the state of liquid within the buffer tank 40, and the driving speed for the second circulation pump 62 can be controlled on the basis of the detection information acquired by the sub tank float sensor (detecting unit). This configuration allows continuously performing the ink circulation/supply operation even while a printing operation is being performed. The amount of ink within an ink circulation/supply path can be acquired. Furthermore, performing the ink circulation/supply operation can keep the increase in temperature of the print head 14 within a predetermined range even a printing operation is performed continuously. Bubbles occurring within an ink channel during a printing operation can be collected, and the negative pressure within the print head can be stabilized.

Having described above the configuration which performs the ink circulation/supply operation while a printing operation is being performed, the ink circulation/supply operation may be performed in a print standby state. Even in a print standby state, performing the ink circulation/supply operation every predetermined period of time can prevent the sedimentation of ink components. It is particularly effective for pigment ink since the pigment components sediment when the pigment ink is left.

Figure 12:
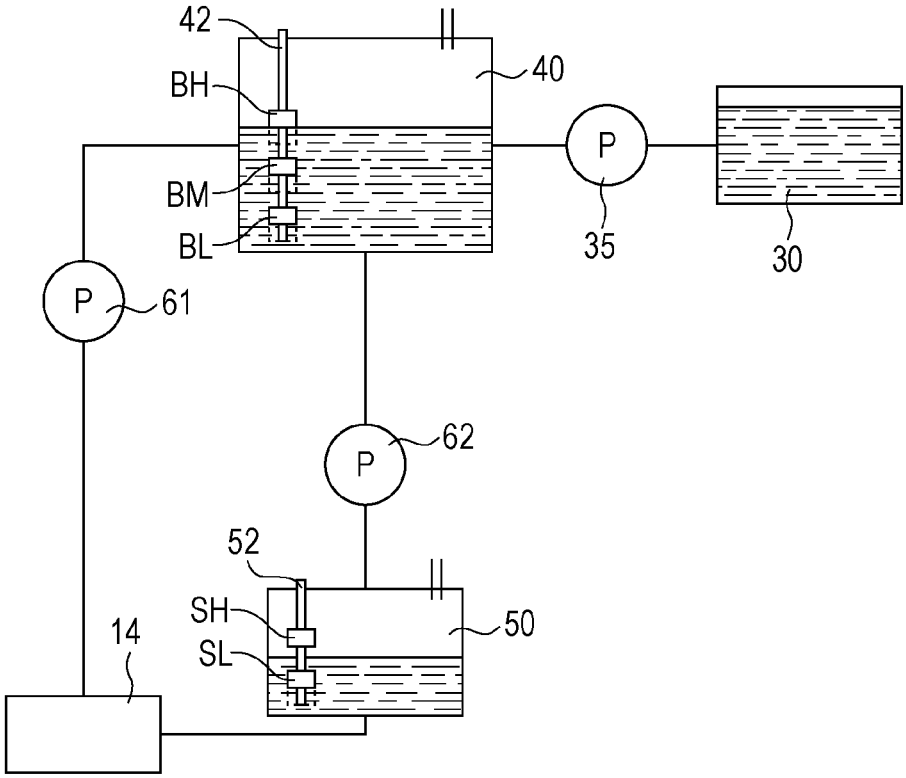
FIG. 12 illustrates an ink circulation/supply mechanism of a variation example of the first embodiment.

FIG. 12 illustrates an ink circulation/supply mechanism of a variation example of the first embodiment. According to the variation example, a buffer tank sensor 42 which is a second liquid-level detecting unit includes a buffer-tank higher float BH, a buffer tank middle float BM, and a buffer-tank lower float BL. According to the variation example, increasing the number of floats allows detection of the liquid level within the buffer tank 40 with high precision. This configuration allows early ink supply from the ink tank 30 to the buffer tank 40.

Second Embodiment

Figure 13:
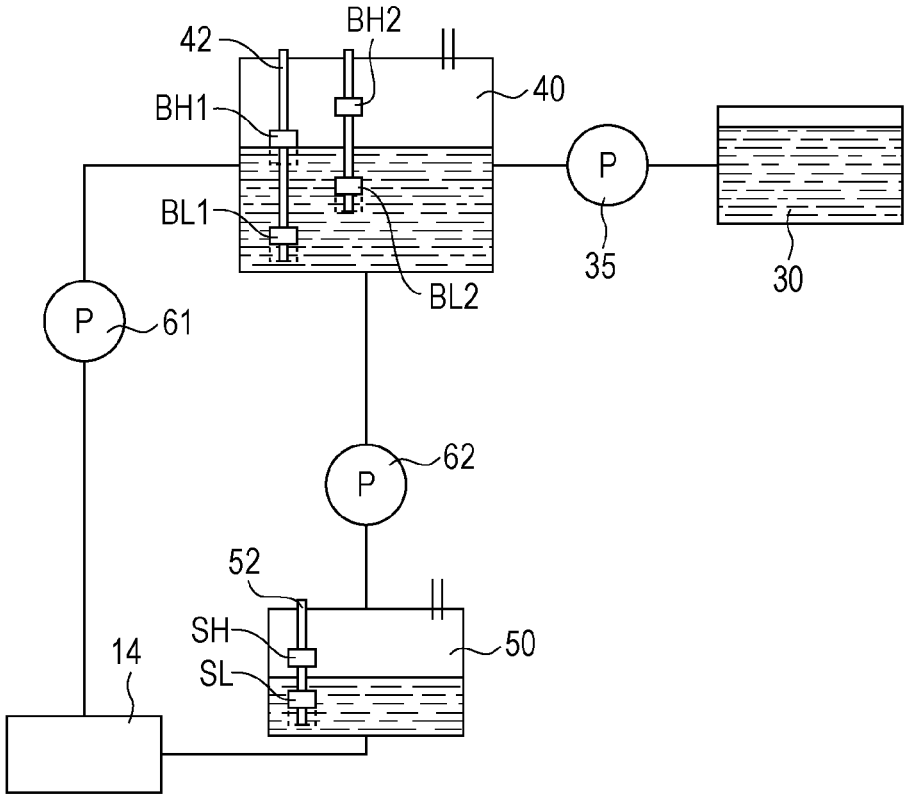
FIG. 13 illustrates an ink circulation mechanism according to a second embodiment.

FIG. 13 illustrates an ink circulation mechanism according to a second embodiment. FIG. 13 also illustrates an ink circulation mechanism for one color, like the first embodiment.

In FIG. 13, a buffer tank sensor 42 which is a second liquid-level detecting unit is provided unevenly at two different levels. The buffer tank sensors 42 includes a first axis which supports a first buffer-tank higher float BH1 and a first buffer-tank lower float BL1 vertically movable in a predetermined range. The buffer tank sensor 42 further includes a second axis which supports a second buffer-tank higher float BH2 and a second buffer-tank lower float BL2 vertically movable in a predetermined range.

Before an ink circulation operation starts, the liquid level in the sub tank 50 is set between the sub tank higher float SH and the sub tank lower float SL. In other words, the sub tank higher float SH has the OFF state, and the sub tank lower float SL has the ON state. The liquid level in the buffer tank 40 is set at a position detectable by the first buffer-tank higher float BH1. In other words, the first buffer-tank higher float BH1, first buffer-tank lower float BL1, and second buffer-tank lower float BL2 have the ON state, and the second buffer-tank higher float BH2 has the OFF state.

When an ink circulation/supply operation starts from the state and ink ejection is performed from the print head 14, the liquid level in the buffer tank 40 falls. The consumption of the ink switches the first buffer-tank higher float BH1 to the OFF state while the second buffer-tank lower float BL2 is kept in the ON state. Thus, the buffer tank sensor 42 which is a second liquid-level detecting unit securely detects that the ink has been consumed.

Accordingly, the supply pump 35 is driven, and ink is supplied from the ink tank 30 to the buffer tank 40 until the second buffer-tank higher float BH2 is switched to the ON state. Here, when the switching of the second buffer-tank higher float BH2 to the ON state is not detected even with the driving of the supply pump 35, it is determined that no ink is available within the ink tank 30. Thus, the necessity for replacement of the ink tank 30 is notified. When a new ink tank 30 is installed, the supply pump 35 is driven, and ink is supplied from the ink tank 30 to the buffer tank 40 until the higher float BH2 is switched to the ON state.

Even when the ink tank 30 is not replaced, the printing operation and the ink circulation/supply operation are performed continuously. In other words, the buffer tank sensor 42 in the buffer tank 40 can perform multipoint detection. Thus, the liquid levels from the first buffer-tank lower float BL1 to the second buffer-tank lower float BL2 and from the second buffer-tank lower float BL2 to the first buffer-tank higher float BH1 are indicted as remaining-amount-of-ink information within the printing apparatus. Presenting the remaining-amount-of-ink information allows a user to learn how much ink is available within the printing apparatus. A user can learn in advance that the printing operation can be performed continuously until the switching of the first buffer-tank lower float BL1 to the OFF state is detected.

According to this embodiment, since the buffer tank sensor 42 can perform multipoint detection as described above, the timing for ink supply from an ink tank can be controlled minutely. The remaining amount of ink in the ink tank 30 can be notified to a user earlier when the buffer tank 40 still contains ink. Thus, the replacement of the ink tank can be urged earlier. This configuration allows a continuous printing operation.

Third Embodiment

Figure 14:
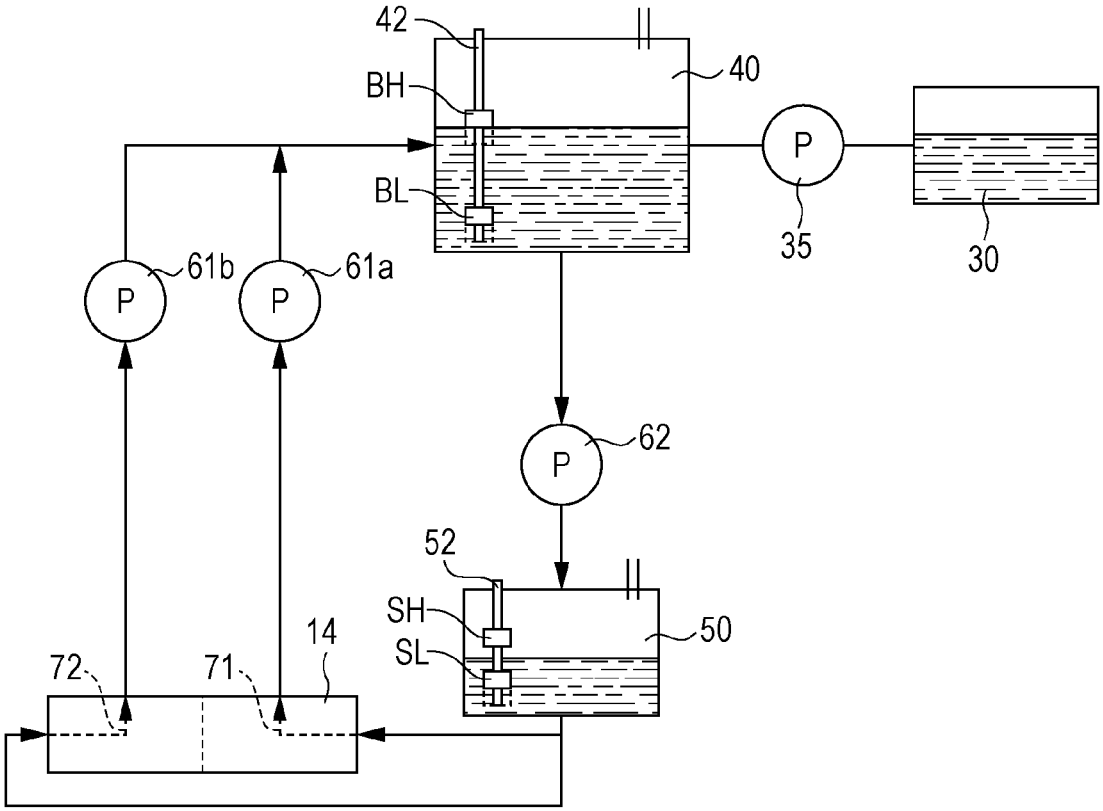
FIG. 14 illustrates an ink circulation/supply mechanism according to a third embodiment.

FIG. 14 illustrates an ink circulation/supply mechanism according to a third embodiment. FIG. 14 also illustrates an ink circulation mechanism for one color like the first embodiment.

According to this embodiment, an ink path within a print head 14 is divided into two channels. In FIG. 14, a path 71 is within a first head within the print head 14*m* and a path 72 is within a second head. A second circulation pump 61*a* corresponds to the path 71 within the first head. The second circulation pump 61*b* corresponds to the path 72 within the second head.

A print head having a full multi structure which performs continuous printing may be large. Furthermore, in order to prevent an increase in temperature of the print head because of continuous printing, the ink path within the head may be divided into two channels. Even the print head having such a configuration can perform an ink circulation/supply operation, like the first and second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-115494 filed May 19, 2010, which is hereby incorporated by reference herein in its entirety.

What is claimed is:

1. A printing apparatus comprising:

a print head which ejects ink;

a first storage tank which stores ink;

a second storage tank which stores ink supplied from the first storage tank and to be supplied to the print head;

a supply path which forms a portion of an ink circulation path configured to circulate ink among the first storage tank, the second storage tank and the print head, the supply path connecting the first storage tank and the print head via the second storage tank;

a collecting path which forms a portion of the ink circulation path and connects the print head and the first storage tank;

a first pump which is provided in the collecting path between the print head and the first storage tank, wherein the first pump is a sole flow control element in the collecting path, causes ink stored in the second storage tank to be supplied to the print head and causes ink to be directly supplied from the print head to the first storage tank;

a second pump which is provided in the supply path between the first storage tank and the second storage tank, wherein the second pump is a sole flow control element in the supply path and causes ink to be directly supplied from the first storage tank to the second storage tank;

a detecting unit which detects an amount of ink stored in the second storage tank; and a control unit which controls driving of the first pump and the second pump, wherein the control unit is configured to drive the first pump at a constant speed when the print head performs a printing operation, increase a driving speed of the second pump, if the detecting unit detects that the amount of ink is lower than a first threshold value, and reduce the driving speed of the second pump, if the detecting unit detects that the amount of ink is higher than a second threshold value greater than the first threshold value.

2. The printing apparatus according to claim 1, wherein the detecting unit has an axis fixed to the second storage tank, and a higher float and lower float through which the axis extends and which are movable vertically in a predetermined range.

3. The printing apparatus according to claim 1, further comprising an ink tank which stores ink to be supplied to the first storage tank.

4. The printing apparatus according to claim 3, further comprising a supply pump for supplying ink from the ink tank to the first storage tank, wherein the control unit controls the driving of the supply pump.

5. The printing apparatus according to claim 4, further comprising a second detecting unit which detects the amount of ink stored in the first storage tank, wherein the control unit drives the supply pump on the basis of the detection result by the second detecting unit to supply ink from the ink tank to the first storage tank.

6. The printing apparatus according to claim 1, wherein the first storage tank is provided at a higher position than the print head and the second storage tank.

7. The printing apparatus according to claim 1, wherein the capacity of the first storage tank is larger than the capacity of the second storage tank.

* * * * *